US006533510B2

(12) United States Patent
Sain

(10) Patent No.: US 6,533,510 B2
(45) Date of Patent: Mar. 18, 2003

(54) CARRIER FOR A TRAILER, SYSTEM THEREOF USING A STACKING DEVICE, AND METHOD THEREOF

(75) Inventor: Bernard S. Sain, Jacksonville, FL (US)

(73) Assignee: International Transport Logistics, Inc., Jacksonville, FL (US)

( * ) Notice: Subject to any disclaimer, the term of this patent is extended or adjusted under 35 U.S.C. 154(b) by 0 days.

(21) Appl. No.: 09/910,051

(22) Filed: Jul. 23, 2001

(65) Prior Publication Data

US 2003/0017020 A1 Jan. 23, 2003

(51) Int. Cl.[7] ..... B60P 3/06

(52) U.S. Cl. ..... 410/56; 410/30; 410/58; 410/65

(58) Field of Search ..... 410/30–46, 56, 410/58, 59, 60, 61, 62, 63, 64, 65, 66, 67, 80

(56) References Cited

U.S. PATENT DOCUMENTS

| | | | | | |
|---|---|---|---|---|---|
| 1,813,169 | A | * | 7/1931 | Kellett | 410/67 |
| 2,010,969 | A | | 8/1935 | Soulis | 414/333 |
| 2,525,388 | A | * | 10/1950 | Willetts | 410/65 |
| 2,585,126 | A | * | 2/1952 | Holland | 410/65 |
| 2,837,038 | A | * | 6/1958 | Fahland | 410/57 |
| 2,851,963 | A | * | 9/1958 | Sheehan | 410/65 |
| 3,003,434 | A | * | 10/1961 | Clejan | 410/60 |
| 3,041,028 | A | * | 6/1962 | McDowell | 410/62 |
| 3,189,307 | A | * | 6/1965 | Peterson | 410/61 |
| 3,547,049 | A | | 12/1970 | Sanders | 410/27 |
| 3,620,388 | A | | 11/1971 | Mansson | 108/53.1 |
| 3,632,145 | A | * | 1/1972 | Davis et al. | 410/64 |
| 4,049,135 | A | | 9/1977 | Glassmeyer | 414/351 |
| 4,592,693 | A | | 6/1986 | Perrot | 414/495 |
| 4,986,705 | A | * | 1/1991 | Durkin | 410/57 |
| 5,183,375 | A | | 2/1993 | Fenton et al. | 410/35 |
| 5,639,174 | A | | 6/1997 | Gonska | 403/103 |
| 6,027,291 | A | | 2/2000 | Sain et al. | 410/35 |

* cited by examiner

*Primary Examiner*—D. Glenn Dayoan
*Assistant Examiner*—Paul Chenevert
(74) *Attorney, Agent, or Firm*—Foley & Lardner

(57) ABSTRACT

A highway trailer carrier has a support base, front and back lift braces attached to the support base, and at least one trailer support attached to the support base for supporting part of the trailer. The support is attachable to the trailer and collapsible so that it does not interfere during loading and unloading. The support base further has wheel wells and anchors for securing the trailer to the support base. Both the support base and the lift braces include mounting fixtures for securing the carrier to other carrier(s) and/or cargo containers, for instance, using a stacking device(s) with twist locks that engage and lock onto the mounting fixtures.

26 Claims, 10 Drawing Sheets

CARRIER FOR A TRAILER, SYSTEM THEREOF USING A STACKING DEVICE, AND METHOD THEREOF

BACKGROUND

Cargo containers for overland and marine freight handling are produced in various standard sizes, including, among others, containers of 20, 40, 45, 48, and 53 feet (length) by 96 or 102 inches (width). As disclosed in U.S. Pat. No. 6,027,291 issued to Sain, et al., these containers are typically shipped in a stacked formation. Different sized containers can be tied and stacked together using the stacking device disclosed in the '291 patent, the disclosure of which is incorporated herein by reference.

The North American Free Trade Agreement (NAFTA) of 1994 and the Trucking Industry Regulatory Reform Act (TIRRA) of 1994 has eased commerce between the U.S., Canada, and Mexico, and promoted interstate trucking competition. The trucking industry uses standard highway trailers, which are integrated with rear wheels and are typically 102 inches in width by 48 or 53 feet in length. Because of the size differences and particularly the fixed wheels, the trailers cannot be stacked one on top of another during transport over rail or water. Instead, the contents of a highway trailer are unloaded from the highway trailer and loaded into a conventional cargo container. This requires a great deal of resources, including additional cargo containers, machinery, labor, etc., to move the contents, not to mention additional considerations, such as damage to the cargo due to rehandling, storage, and theft.

In this respect, U.S. Pat. No. 4,049,135 issued to Glassmeyer discloses hauling a cargo container itself on a truck flatbed, instead of a standard highway trailer. This requires a flatbed, which is not a standard trailer. It would be more convenient to transport the highway trailer itself so that upon unloading, a truck can just hitch onto the trailer and drive off.

Accordingly, there is a need to directly transport a conventional highway trailer by rail or water. The present invention meets this need.

Additionally, if one considers the world's most affected areas, e.g., Puerto Rico, Virgin Islands, Dominican Republic, Hawaii, Alaska, and Guam, these trades, like most of the world, are serviced primarily by "pure" LO/LO (lift-on/lift-off) container vessels with little or no RO/RO (roll-on/roll-off) space for wheeled cargo, such as trailers. The present invention also addresses the solution to this infrastructure problem, which solution requires no permanent modifications to either trailer or vessel design, or significant cost expenditure.

SUMMARY OF THE INVENTION

The present invention relates to a highway trailer carrier, a system that includes the carrier and at least one stacking device, and a method thereof.

The carrier according to the invention includes a support base having a support area for accommodating trailer wheels, at least one lift brace attached to the support base, and at least one trailer support attached to the support base for supporting a part of the trailer remote from the trailer wheels.

The trailer support can be collapsible, and adjustable at least between a first position and a second position, which is positioned inwardly of the first position along a longitudinal direction of the support base. The support can include a first section and a second section. The first section can be attached to the support base and the second section can be adjustably and pivotally connected relative to the first section. Specifically, the first section can comprise a pair of front rails and a pair of back rails secured to the support base, and the second section can comprise a front member and a back member, respectively connected to the front and back rails. The front and back members are connected together. Specifically, the front and back members can be detachably connected together.

The front member is substantially upright and the second member is angled when the front and back members are connected to each other. The second member keeps the second member from pivoting relative to the front rails. The front and back members are movable together as a unit between at least the first and second positions. The front member can include a connecting plate for securing the front member to the trailer.

The support base can include a pair of guide rails for guiding the trailer wheels, which are rear wheels, and wheel wells for accommodating the rear wheels. Each of the wheel wells can include at least one wheel stop to prevent the trailer wheels from moving beyond the respective wheel wells. The guide rails can diverge outwardly along the ramp. The support base can further include at least one ramp for loading the trailer onto the support base.

The support base can include anchors for securing the trailer to the support base. These anchors can comprise D-rings pivotally mounted to the support base. The bottom of the support base can include at least four mounting fixtures. The sides of the support base also can include at least four mounting fixtures.

The at least one lift brace can comprise a front lift brace and a back lift brace attached respectively to front and back portions of the support base. Each of the lift braces can include at least two mounting fixtures.

The system can include some or all of the features of the carrier described above, but having a plurality of mounting fixtures at least on the base for receiving twist locks of the stacking device.

According to the method of transporting a highway trailer on a transport, the steps include providing a carrier for supporting the trailer, which has at least a set of rear wheels, loading the trailer onto the carrier by backing the trailer onto the carrier, supporting a front end portion of the trailer on the carrier, such as by using the trailer support described above, anchoring the trailer to the carrier, such as by using the anchors described above, providing at least one stacking device, locking the stacking device onto a stationary part of the transport, lifting the carrier and lowering the carrier onto the stacking device, and locking the carrier to the stacking device. The stationary part of the transport can include a deck of the transport, one of more cargo containers anchored to the transport, or other carrier or any stationary area. Again, the carrier can be locked using the mounting fixture and stacking device combination or the mounting fixtures with twist locks.

DETAILED DESCRIPTION

Figure 1:
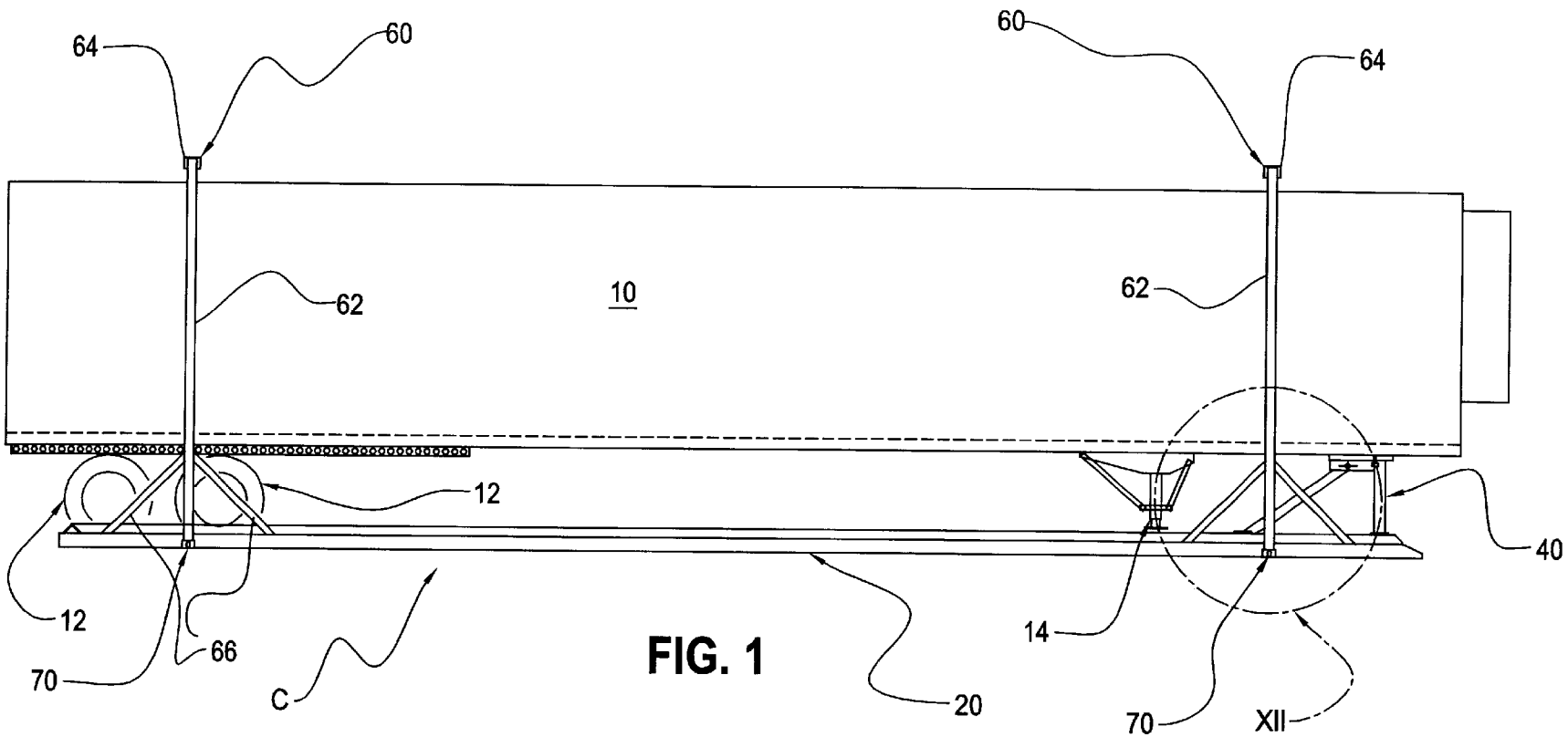
FIG. 1 is a side view of a carrier for a highway trailer according to the present invention, with a movable trailer support in a first use position.
Figure 2:
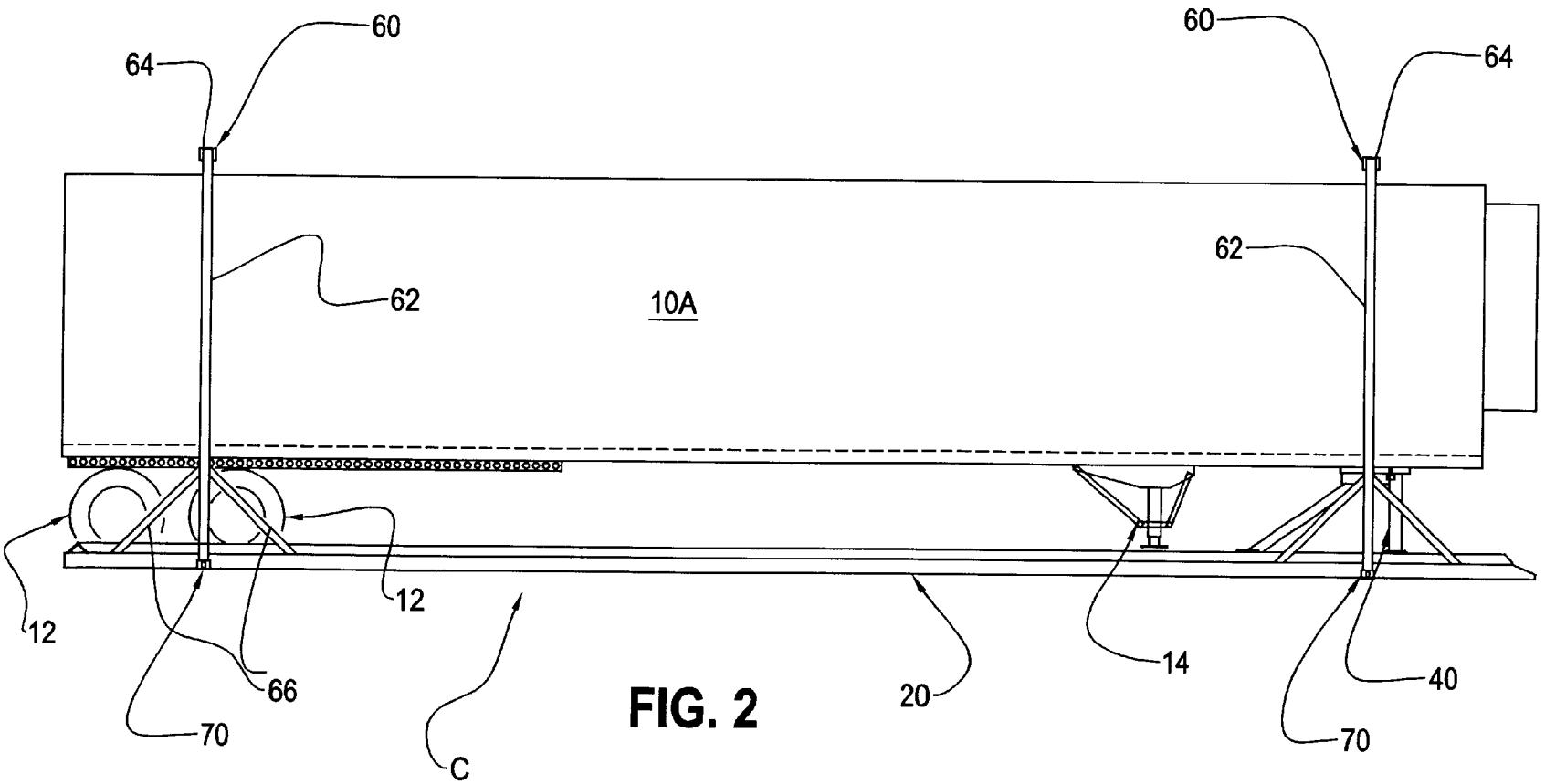
FIG. 2 is a side view of the carrier of FIG. 1 with the movable trailer support in a second use position for supporting a shorter highway trailer.

Referring to FIGS. 1 and 2, the illustrated carrier C includes a support base 20 for supporting a trailer 10, 10A and at least one lift brace 60 (pair shown). A pair of braces (front and back) 60 can be used if an additional carrier(s) is stacked on top. The front and back braces can be attached respectively to front and back portions of the support base 20. The trailer 10, 10A typically includes at least one set (two sets illustrated) of rear wheels 12 and at least one jack 14 (commonly known as a landing gear) near its front end for supporting the trailer 10, 10A on the ground when it is not hitched to a truck (not illustrated). Although the support jack 14 can be used to support the trailer 10, 10A on the carrier C, the carrier C includes its own support or a fifth wheel 40 for supporting a front end of a trailer 10, 10A. The trailer support 40 is attached to the front portion of the support base 20 and is adjustable to accommodate different sized trailers 10, 10A. The support jack 14 can be lowered onto the support base 20, in addition to the trailer support 40, to additionally support the trailer.

Referring to FIGS. 3–6, the illustrated support base 20 includes a support frame 20F comprising a plurality of floor beams 22, 22A and a pair of opposing side rails 24 connected to the ends of the floor beams 22. The base 20 further includes an upper platform or deck 26 connected to and positioned over the floor beams 22. The illustrated floor beams 22, 22A are substantially parallel to each other, but they can be arranged in any conventional fashion suitable for supporting a heavy load. For example, they could be diagonal to the side rails 24 or perpendicular to each other, or parallel to the side rails 24. Furthermore, the support frame 20F can be made of a solid substrate, which can include holes or cutouts to reduce the weight, or any suitable structure for supporting a heavy load.

Figure 4:
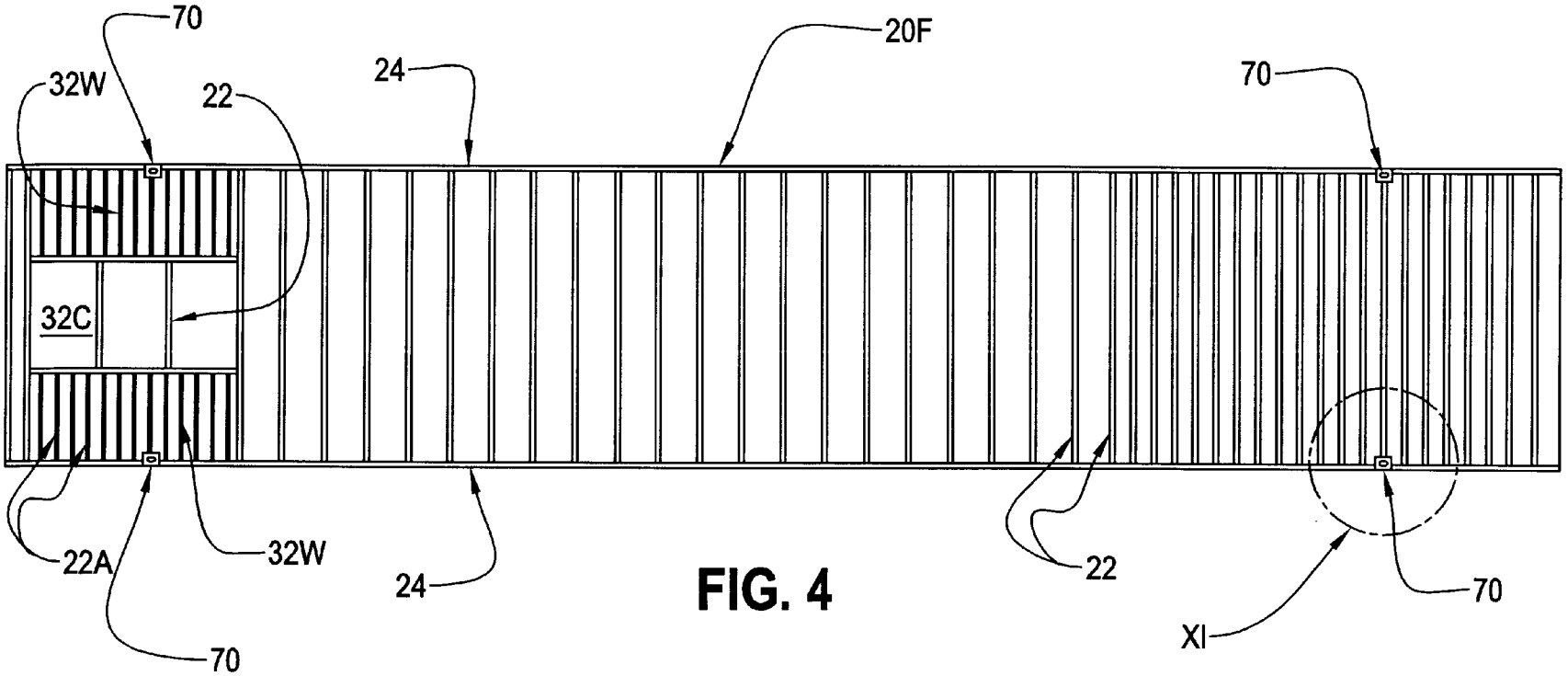
FIG. 4 is a bottom view of FIG. 1, illustrating a support base frame.

The illustrated support beams 22 have a varying density pattern. In particular, the spacing between the floor beams 22 at the front and back portions of the support base 20, namely in the regions where the trailer support 40 is attached to the support base 20 and where the trailer wheels 12 are stationed, is made smaller than the mid area. In other words, there are more beams 22 at the regions supporting the trailer, as illustrated in FIG. 4, for reinforcement.

Figure 3:
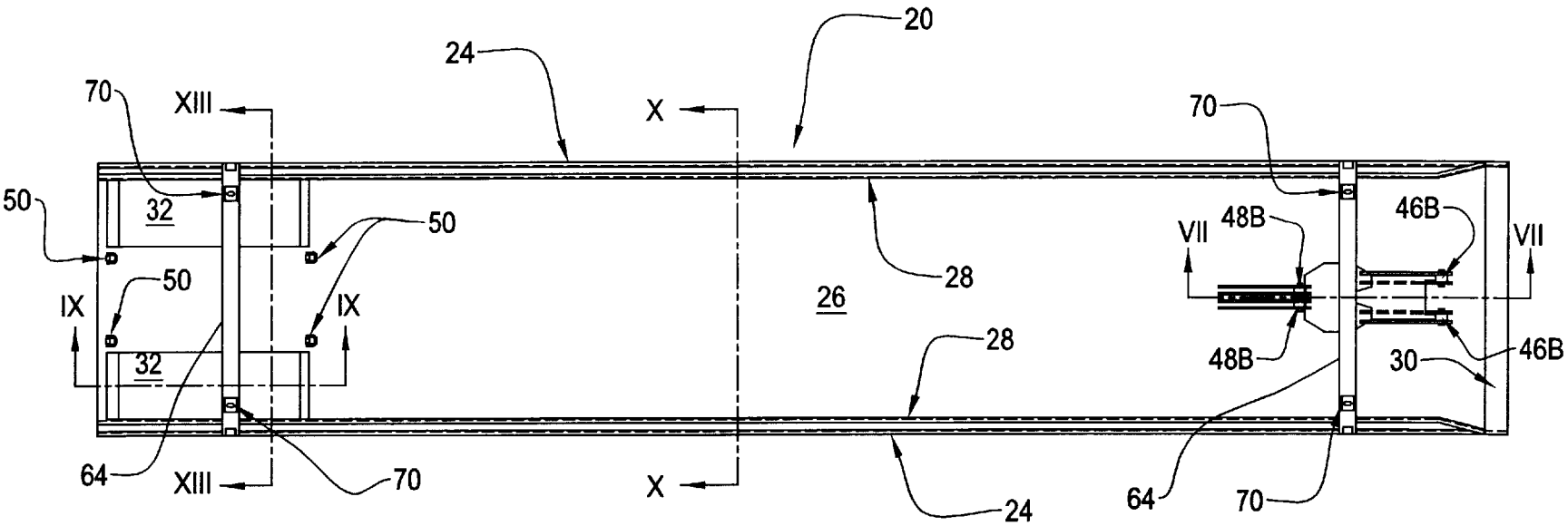
FIG. 3 is a top view of FIG. 1 with the trailer omitted and the movable trailer support in a collapsed position.
Figure 10:
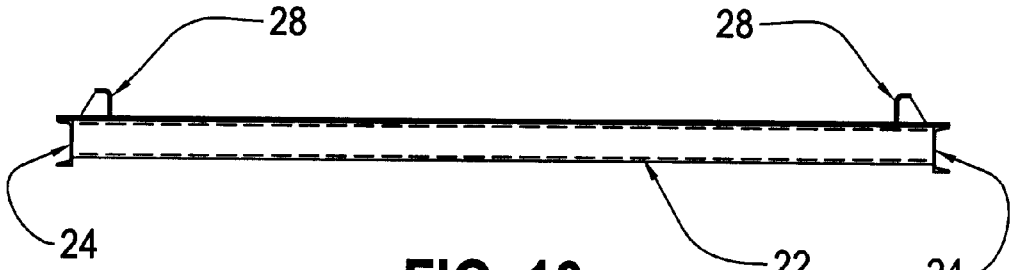
FIG. 10 is a cross-sectional view taken along line X—X of FIG. 3.
Figure 11:
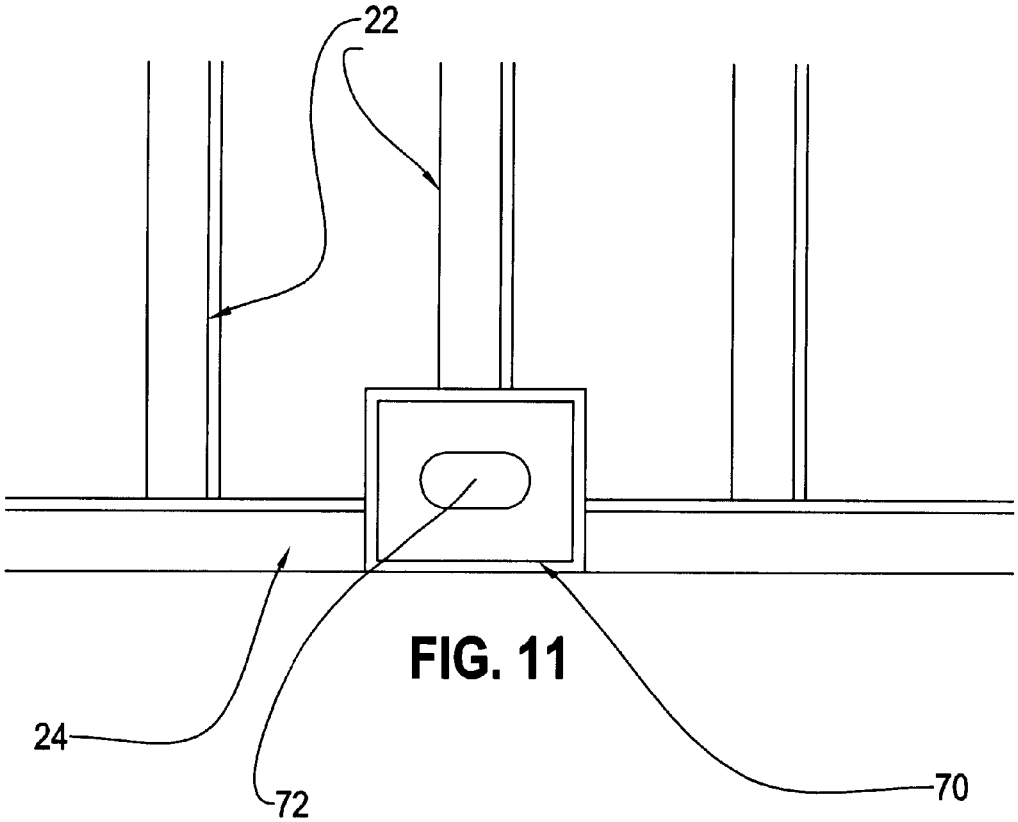
FIG. 11 is an enlarged view of the bottom twist lock casting taken along section XI of FIG. 4.
Figure 12:
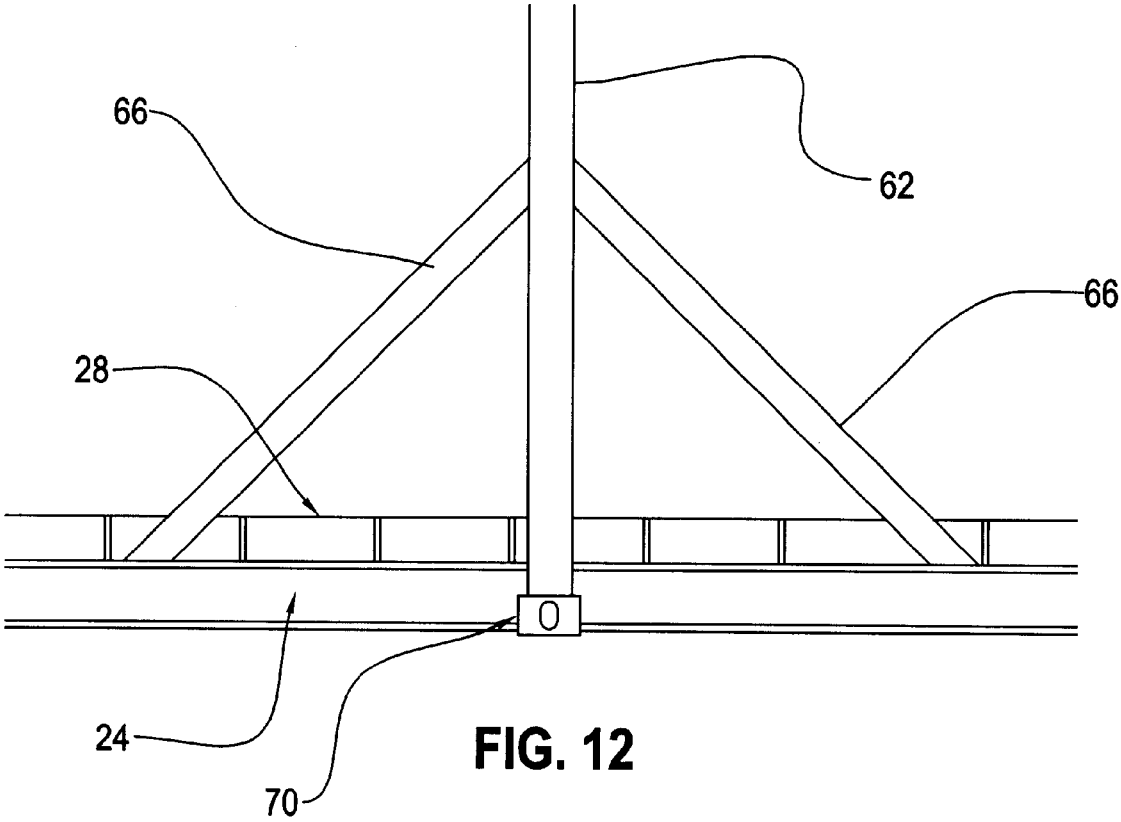
FIG. 12 is an enlarged view of a lower portion of the lift post taken along section XII of FIG. 1.

Referring to FIGS. 3 and 10, the support base 20 has, on its upper sides of the support frame 20F, a pair of side guide rails 28, which are arranged typically parallel to the lengthwise direction of the support base 20, as illustrated in FIGS. 1–3. Each side guide rail 28 sits on top of the deck 26 and spaced apart to accommodate the width of the trailer wheels 12, i.e., spaced slightly greater than the spacing of the trailer wheels 12. The front end of the support base 20 has a ramp 30 for assisting the entry of the trailer 10, 10A onto the carrier C.

The guide rails are designed to guide the trailer wheels 12 as the trailer is backed onto the support base 20. In this respect, the guide rails 28 are substantially parallel except in the region near the front. Here, the guide rails 28 diverge outwardly toward the side rails 24 (or converge inwardly toward the back) to create a wider mouth at the ramp 30 to accommodate alignment errors while loading the trailer 10, 10A onto the carrier C. While the trailer wheels 12 do not initially have to be aligned with high precision, the inwardly converging configuration of the guide rails 36 forces the wheels 12 into the proper alignment with the carrier C. The guide rails 28 also align the trailer 10, 10A relative to the carrier C, i.e., so that it remains between the guide rails 28.

Figures 5, 6:
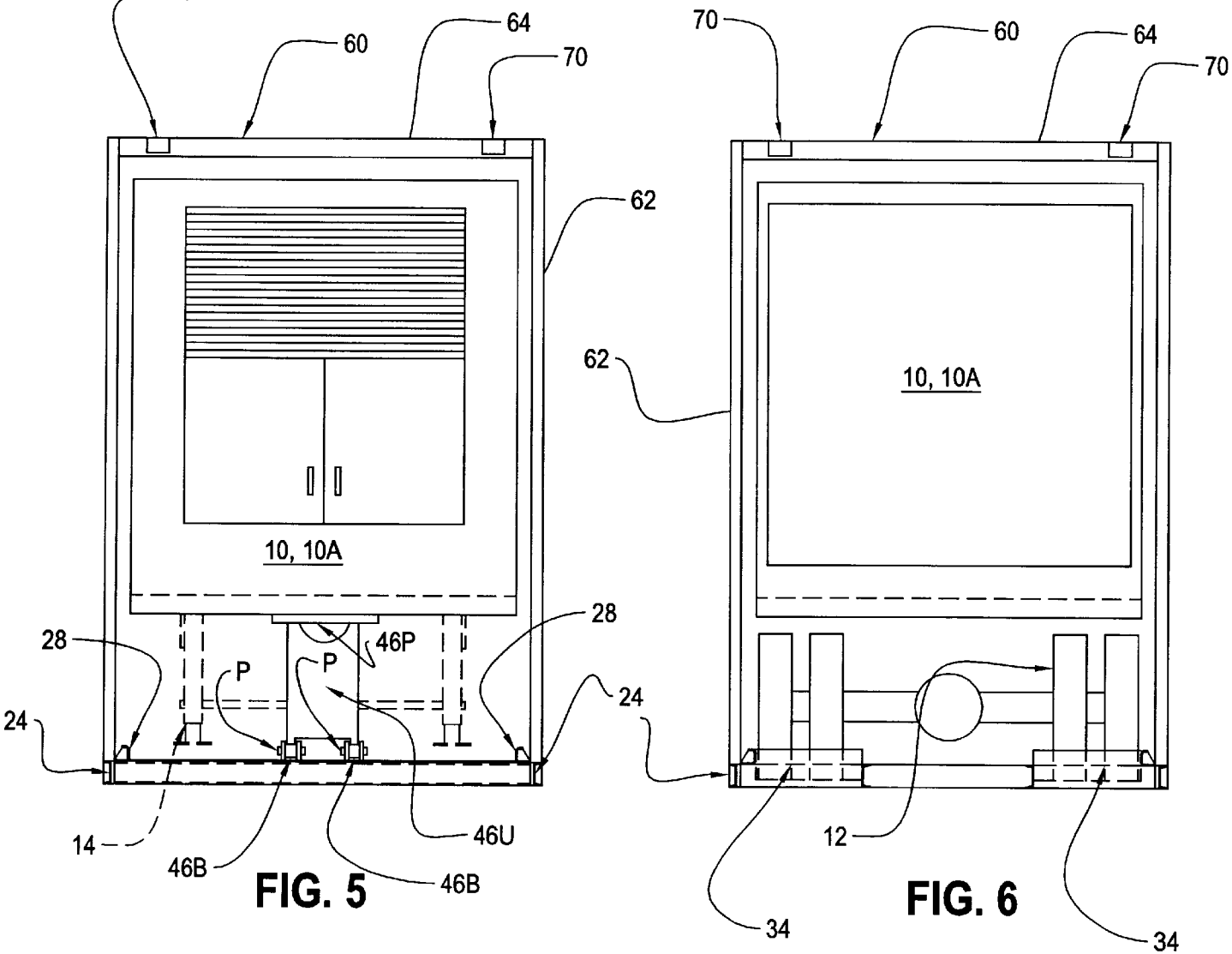
FIG. 5 is a front view of the carrier of FIG. 1 supporting a highway trailer.
FIG. 6 is a rear view of the carrier of FIG. 1 supporting a highway trailer.
Figure 9:
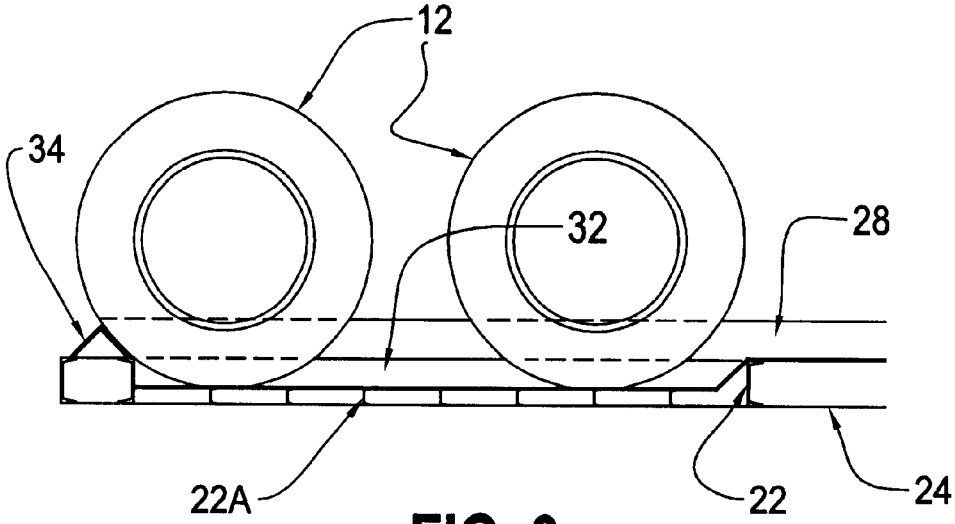
FIG. 9 is a cross-sectional view taken along line IX—IX of FIG. 3.

Referring to FIGS. 3, 6, and 9, the support base 20 also includes wheel wells 32, which comprise recesses extending below the top deck level, for accommodating the trailer wheels 12 when the trailer is parked on the carrier C. The support base 20 further includes wheel stops 34 for positioning the trailer wheels 12 accurately on the carrier C. Because the top surface of the wheel wells 32 is lower than the top surface of the deck 26, the wheels tend to be held in place by gravity. The wheel stops 34 compound this effect.

Referring to FIGS. 4 and 9, the back section of the support frame 20F has two wheel well sections 32W sandwiching a center section 32C. The center section 32C uses the same beams 22 (but shorter in length) as the rest of the support frame 20F. Each of the well sections 32W uses shallower (height) and shorter (length) beams 22A to provide the height offset or difference to create the recesses. The recess can be about 6" to 8," which would help to secure trailer during rough sea weather. The well sections 32W also has a higher density of beams, as previously explained.

Figure 7A:
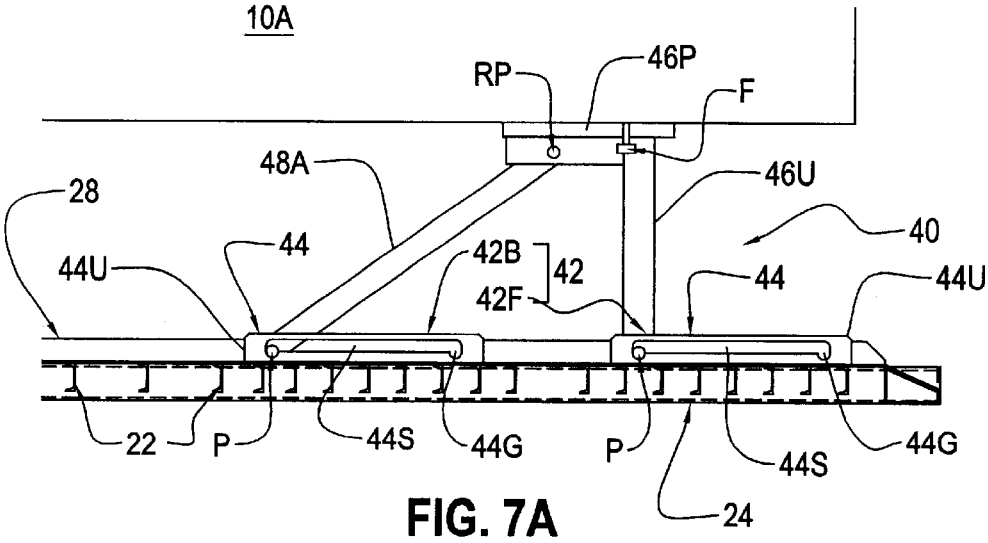
FIG. 7A is a view similar to FIG. 7, but illustrating the movable trailer support in the second use position (an inward position for supporting the shorter highway trailer of FIG. 2).
Figure 7:
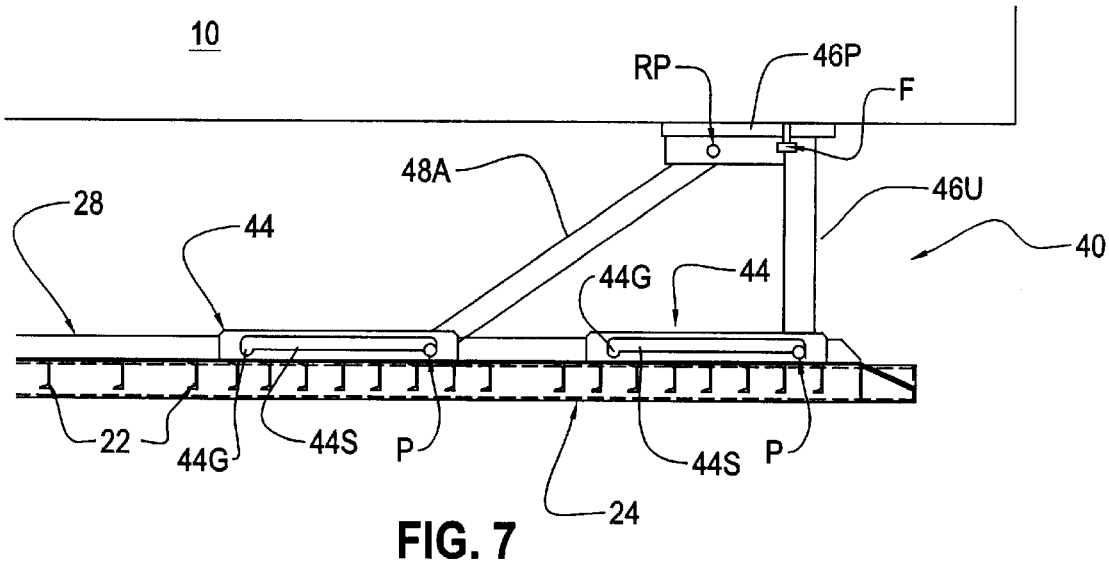
FIG. 7 is an enlarged view taken along line VII—VII of FIG. 3, illustrating the movable trailer support in the first use position (an outward position for supporting the longer highway trailer of FIG. 1).

FIGS. 1, 2, 7, and 7A illustrate the trailer support 40 in its up or support position. The trailer support 40 is arranged on the support base 20. FIGS. 1 and 7 illustrate the trailer support 40 in a first or outward position for supporting a longer trailer 10, e.g., a 53 foot trailer, whereas FIGS. 2 and 7A illustrate the trailer support 40 in a second or inward position for supporting a shorter trailer 10A, e.g., a 48 foot trailer.

FIGS. 3, 5, 7, and 7A illustrate the trailer support 40 in detail. The trailer support 40 is adjustable between at least the first and second positions, and is collapsible so that it does not interfere with the trailer 10, 10A while loading onto and unloading from the carrier C. The trailer support 40 has a first section comprising stationary components (42) and a second section comprising movable components (46, 48). The movable components are configured to be movable and pivotable, and detachable from each other so that they can be collapsed.

The stationary components comprise anchor rails 42 positioned along a longitudinal direction of the carrier C. Specifically, the illustrated embodiment uses a pair of side-by-side back rails 42B and a pair of side-by-side front rails 42F. The front rails 42F, which are configured to take the most of the load of the front portion of the trailer 10, 10A, are spaced apart wider than the back rails 42B for greater stability. These rails 42F, 42B can use pin and slot configuration to allow adjustments between at least the first and second positions. Grooves and gravity are used to lock the movable components to the first and second positions.

Each rail 42F, 42B comprises a pair of spaced apart anchor plates 44 secured to the support base 20 using conventional means, such as bolts, rivets, welding, etc. The pair of anchor plates have upright portions 44U that are spaced apart and parallel with each other. These upright portions 44U are aligned in the longitudinal direction of the support base 20 and each have a slot 44S also aligned in the longitudinal direction. The pair of slots 44S are aligned to allow a roller or pin P to slide or move within the confines of the pair of aligned slots 44S. Each upright portion 44U also has a downwardly recessed groove 44G at each end of the slot 44S. The grooves 44G act as a gravity-based lock for positioning the movable components at the first and second positions. The grooves 44G function similar to the wheel wells 32, which act as a gravity-based locks for the wheels 12 discussed previously. If more than two positions are needed, the anchor plates 44 can be made longer with longer slots 44S and additional grooves 44G placed between the ends of the slots 44S.

Alternatively, instead of the rails 44, an inverted U-shape channel with a plurality of holes can be arranged. The channel can extend substantially the full length of the carrier if desired to provide more extensive positions for the support 40.

The movable components comprise a first or front member 46 and a second or back member 48. The first and second members 46, 48 are detachably and pivotally connected. The first member 46 is connected to the pair of front rails 42F and the second member 48 is connected to the pair of back rail 42B. The second member 48 is designed to keep the first member 46 from pivoting. Specifically, in the illustrated embodiment, the first member 46 comprises an upright member 46U and a trailer anchoring or connecting plate 46P at its top. Accordingly, the first member 46 supports most of the load placed on the trailer support 40. The second member 48 comprises an angled member 48A pivotally connected to the anchoring plate 46P using a removable pin RP, for example. The removable pin RP can, for example, have a conventional ball and spring lock to maintain the pin RP in place. To remove the pin, the ball and spring lock can include a manual actuator, e.g., a button, to allow the ball to move inwardly and pass the pin RP through a respective opening or similar configuration.

The lower portion of the upright member 46U can have a pair of bushings 46B for receiving the pair of pins P for the two front rails 42F. Similarly, the lower portion of the angled member 48A can have a pair of bushings 48B for receiving the pins P for the two back rails 42B. When the first and second movable members 46, 48 are connected together, the first and second movable members 46, 48 operate in unison as a single unit. That is, they can be moved together to one of the first and second positions. When the removable pin RP is taken out to detach the first and second members 46, 48, each of the first and second members 46, 48 is free to rotate or pivot about the respective rails 42F, 42B. This allows the first and second members 46, 48 to be collapsed. After the movable members 46, 48 have been positioned (either first or second position), the anchoring plate 46P can be anchored or secured to the trailer 10, 10A using conventional fasteners F, such as bolts, screws, bayonet mount, etc.

One skilled in the art will recognize many variations on the trailer support 40 that do not deviate from the spirit of the present invention. For example, the trailer support 40 need not be adjustable for a carrier that is designed for only one size highway trailer. Further, the trailer support 40 need not be located at the front portion of the support base 20, and there can be more than one trailer support 40, each located near one side of the support base 20. Furthermore, the trailer support 40 need not be secured to the trailer 10, 10A, and other lowering mechanism, e.g., telescoping, can be used instead of a pivoting mechanism.

Figure 8:
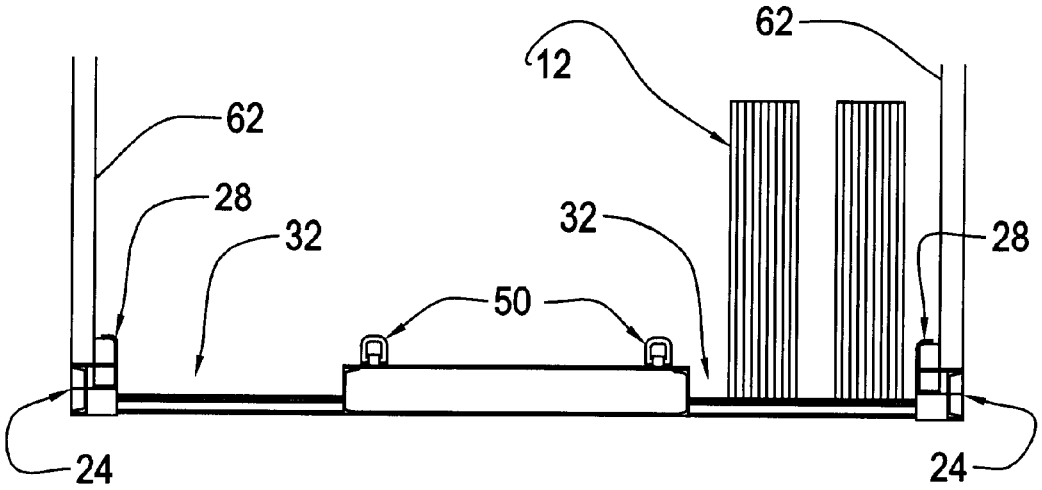
FIG. 8 is a cross-sectional view taken along line VIII—VIII of FIG. 3.

Referring to FIGS. 3 and 8, the support base 20 can also include anchors 50 for securing the trailer 10, 10A to the carrier C. The anchors 50 can be D-rings, which can be configured to pivot. For instance, each of the D-rings can have a securing member secured to the support frame 20F in such a way that it can rotate about a substantially vertical axis. The straight portion of the D-ring can be inserted through a horizontal hole in the securing member so that the D-ring is pivotal substantially about a horizontal axis. This provides two degrees of rotational axis for the anchors 50. The trailer 10, 10A can be tied down to the anchors 50 using straps, belts, chains, or other fastening means once it has been loaded onto the carrier C. Although the illustrated embodiment only shows four anchors 50 positioned at the back or rear portion of the carrier C (between the wheel wells 32), any number of anchors 50 can be positioned at different portions of the carrier C. For instance, additional anchors 50 can be placed at the front and mid portions of the support base 20.

Referring to FIGS. 1–3 and 12, the front and back lift braces 60 are used to lift the carrier with the trailer 10, 10A. Each of the front and back lift braces 60 is substantially U-shaped, having a pair of upright members 62 connecting a horizontal member 64. The free ends of the upright members 62 are secured to the support base 20. To stabilize and strengthen the lift braces 60, a pair of diagonal support braces 66 are connected, one on each side (along the longitudinal direction), to each upright member 62.

Referring to FIGS. 1–4, 11, and 12, the front and back lift braces 60 and the support base 20 further include a plurality of standard mounting fixtures 70 adapted for use with standard twist locks or other functionally equivalent locks for securing standard cargo containers. An embodiment of the twist lock is disclosed in the previously mentioned '291 patent, the disclosure of which is incorporated herein by reference. Specifically, the twist lock (not illustrated here) includes an expandable male connector that can be inserted, in its unexpanded state, into a standard recess 72 formed in the standard mounting fixture 70. Thereafter, twisting its actuator expands the male connector.

The illustrated carrier C has twelve standard mounting fixtures 70, four at the bottom of the support frame 20F, four at the side rails 24, and four at the top of the front and back lift braces 60. The spacing and location of these mounting fixtures 70 can be configured for standard ISO twist lock arrangement for a 96" wide container or any desired arrangement for particular needs.

Figure 13:
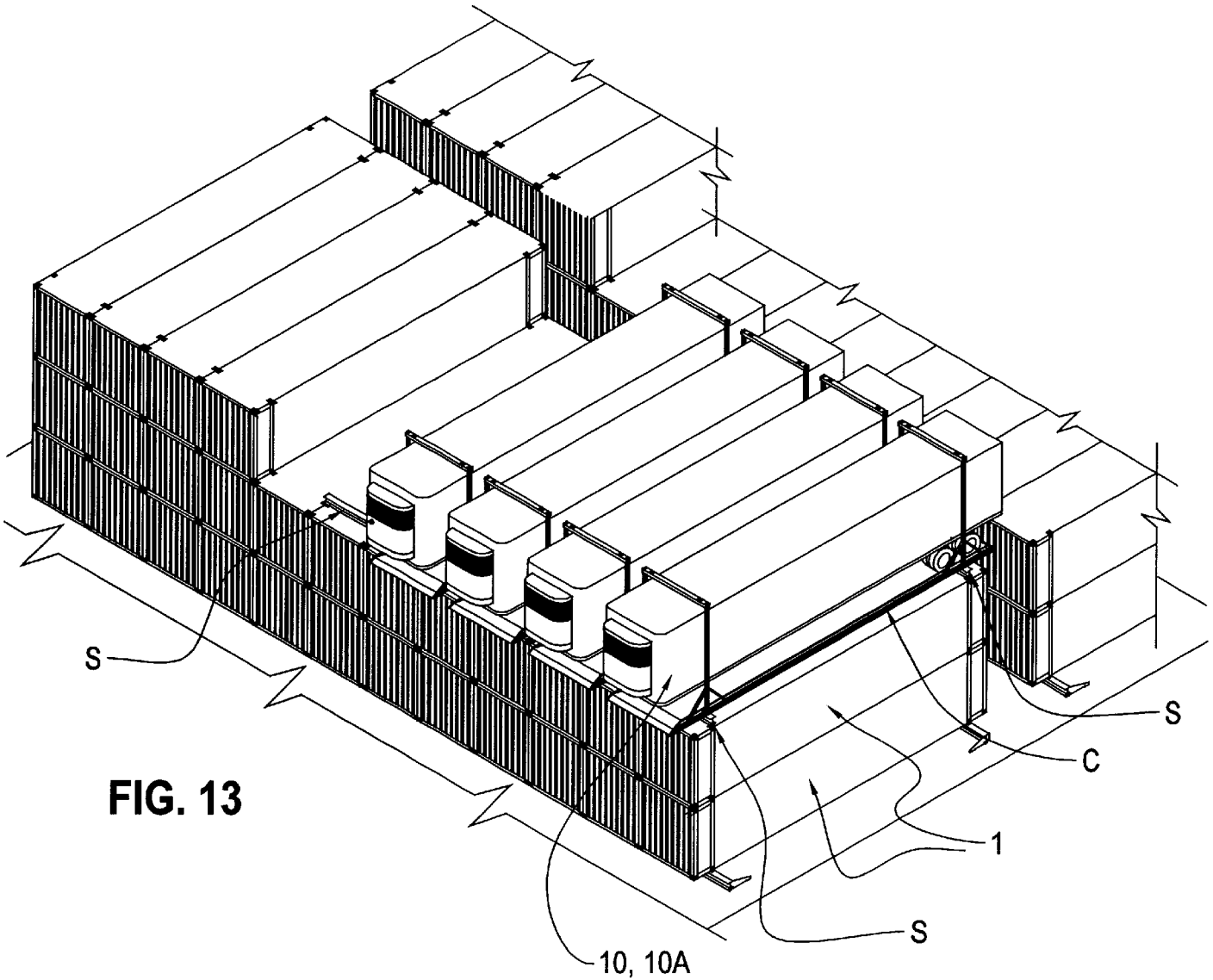
FIG. 13 illustrates a perspective view of a plurality of the present trailer carriers stacked on conventional cargo containers.
Figure 14:
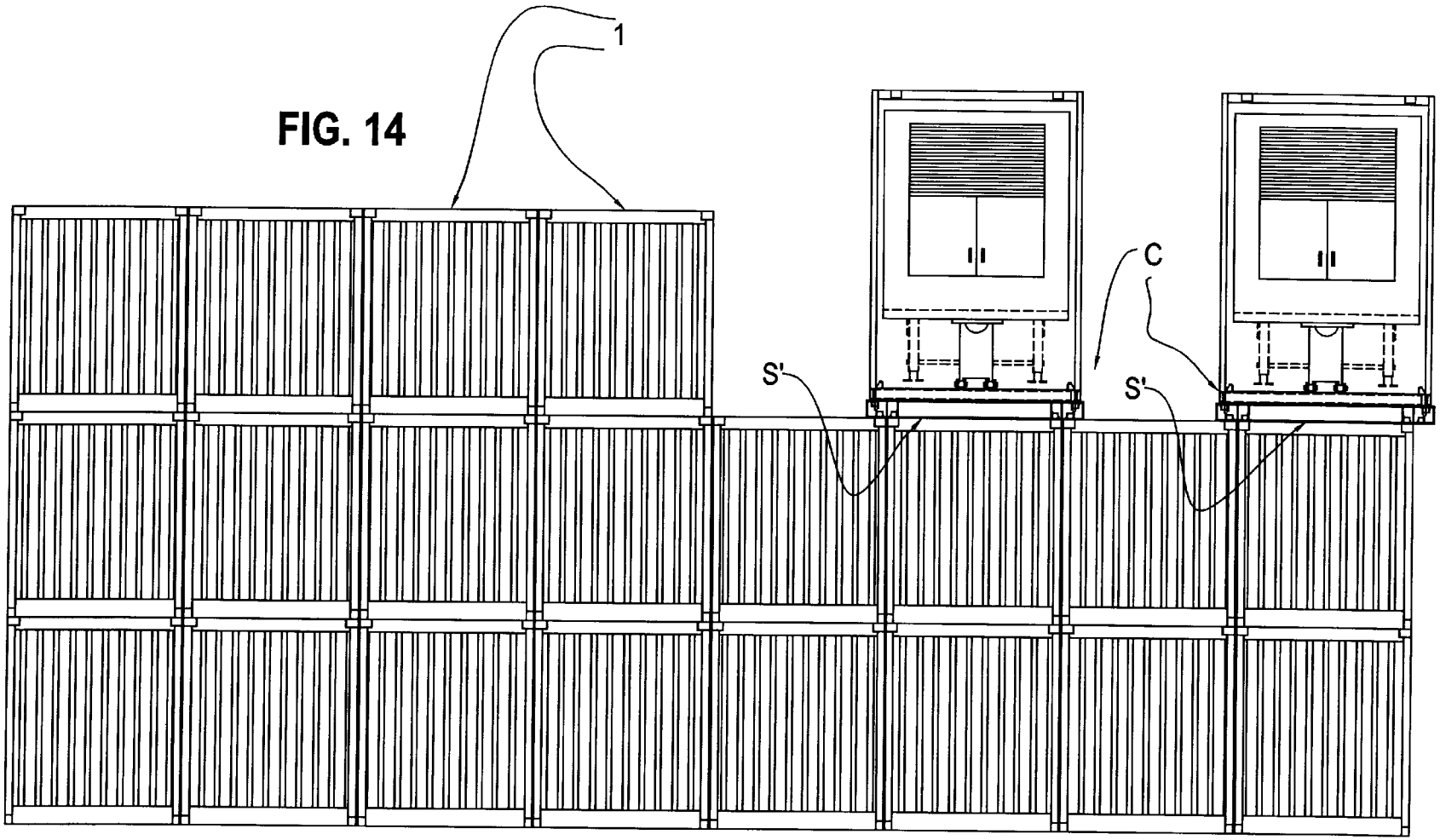
FIG. 14 is a front view of the present trailer carrier stacked on conventional cargo containers in a different configuration.

Referring to FIGS. 13 and 14, a stacking device S, S' disclosed in the previously mentioned 291 patent can be used to attach the carrier C to standard cargo containers 1. As previously indicated, the disclosure of the stacking apparatus is incorporated herein by reference. Accordingly, the detail description of the stacking apparatus, including the twist lock, is not provided or illustrated.

Referring to FIG. 13, a pair of stacking devices S can be mounted onto a plurality of standard ISO cargo containers 1 using twist locks and mounting fixtures 70. Thereafter, two carriers C can be lowered on top of the stacking devices S, placed side-by-side, and lock onto the stacking devices S using the four bottom mounting fixtures 70 and four twist locks for each carrier C. FIG. 13 shows two pairs of stacking devices for mounting four carriers side-by-side.

Referring to FIG. 14, a pair of stacking devices S' can be mounted onto a single ISO cargo container, again using twist locks and mounting fixtures 70. Thereafter, a single carrier C can be lowered on top of the stacking devices S' and lock onto the stacking devices S' using the four bottom mounting fixtures 70 and four twist locks. FIG. 14 shows two pairs of stacking devices S' for anchoring two carriers C side-by-side Moreover, additional cargo container or carrier C can be stacked on top of the front and back lifting braces 60, using the four mounting fixtures 70 on the front and back lifting braces 60 and a pair of stacking device S'. Moreover, additional carriers C can be connected side-by-side using the stacking devices S, S'. Furthermore, the top mounting fixtures 70 of the lifting braces 60 can be used to attach the carrier C to another device, such as a standard spreader device or a container crane (not shown), so that the carrier C can be lifted and moved to a desired location (for example, on top of other cargo containers ready for rail travel).

In operation, a trailer 10, 10A is backed or rolled onto the support base 20. This can be done by first collapsing the movable components (46, 48) by detaching the movable pin RP and pivoting the first and second members 46, 48 so that they fall closer to the deck 26. Then, after the trailer wheels 12 are aligned with the ramp 30 so that they fall between the guide rails 28, the trailer is backed onto the support base 20. If the trailer 10, 10A is not properly aligned, the guide rails 28 will rub against the wheels as the trailer 10, 10A is backing up. The guide rails 28 will guide the rear wheels 12 into proper alignment, however, if the misalignment is slight. The trailer 10, 10A is backed up until the wheels 12 fall into wheel wells 32. The wheel stops 34 impede the trailer from further backing up out of the wheel wells 32.

The first and second movable components (46, 48) of the trailer support 40 are raised to support the trailer 10, 10A by pivoting the first and second members 46, 48 and connecting together with the removable pin RP, and moving them to either the first position (FIG. 1) or the second position (FIG. 2), depending on the trailer size. The propulsion means for moving the trailer into the carrier C, e.g., truck, tractor, etc., is detached from the trailer so that the trailer support 40 can now support the trailer 10, 10A. Then the movable components (46, 48) can be connected to the trailer with fasteners F. The trailer can then be further secured to the carrier using the anchors 50 and conventional tie-down means, e.g., straps, chains, belts, etc.

A standard spreader device or container crane can lift the carrier C, by hitching onto the mounting fixtures 70 on the lift braces 60 using twist lock or the like. The carrier C can be lowered onto cargo containers 1 or the deck of the transport, e.g., ship, train, which is prepared with a stacking devices S, S'. That is, the stacking devices can be preattached to the cargo containers or the deck of the transport using, for example, twist locks. Several carriers C can be locked side-by-side, and/or stacked on top of each other using the stacking devices S, S'. Further, additional cargo containers 1 can be stacked on top of the carriers C using the stacking devices S, S'.

The sequence of unloading of the carrier C from the transport is in the reverse order. After the carrier C has been unloaded, the tie down means released, a truck can back up and hitch onto the trailer. Thereafter, the trailer support can then be collapsed to allow the truck to drive out to its destination. The present invention derives tremendous benefits since it eliminates separate loading and unloading of the content to and from the trailer.

The present invention provides flexibility in that it can be used to transport a trailer of any type and size. The ability to safely and correctly carry aboard today's modern container vessels adds a significant new dimension to the use of common highway trailer and presents a tremendous asset to the cargo industry. The present invention provides an economical and efficient way of integrating highway trailers with today's high-speed state-of-the-art LO/LO container ships in sufficient volume to make their use feasible in world commerce.

What is claimed is:

1. A highway trailer carrier comprising:

a support base having a support area for accommodating trailer wheels;

a front lift brace and a back lift brace attached respectively to front and back portions of the support base;

at least one trailer support attached to the support base for supporting a part of the trailer remote from the trailer wheels; and wherein each of the lift braces include at least two mounting fixtures.

2. A carrier according to claim 1, wherein the trailer support is collapsible.

3. A carrier as according to claim 2, wherein the trailer support is adjustable at least between a first position and a second position, which is positioned inwardly of the first position along a longitudinal direction of the support base.

4. A carrier as in claim 3, wherein the trailer support comprises a first section and a second section, the first section being attached to the support base and the second section being adjustably and pivotally connected relative to the first section.

5. A carrier according to claim 1, wherein the trailer support comprises a pair of front rails and a pair of back rails secured to the support base, and a front member and a back member, respectively connected to the front and back rails, the front and back members being connected.

6. A carrier according to claim 5, wherein the front member is substantially upright and the second member is angled when the front and back members are connected to each other, the second member being adapted to keep the second member from pivoting relative to the front rails.

7. A carrier according to claim 6, wherein the front and back members are movable together as a unit between at least a first position and a second position.

8. A carrier according to claim 7, wherein the front member includes a connecting plate for securing the front member to the trailer.

9. A carrier according to claim 1, wherein the support base includes a pair of guide rails for guiding the trailer wheels, which are rear wheels.

10. A carrier according to claim 9, wherein the support base includes wheel wells for accommodating the rear wheels.

11. A carrier according to claim 10, wherein each of the wheel wells includes at least one wheel stop to prevent the trailer wheels from moving beyond the respective wheel wells.

12. A carrier according to claim 1, wherein the support base includes at least one ramp for loading the trailer onto the support base.

13. A carrier according to claim 12, wherein the guide rails diverge outwardly along the ramp.

14. A carrier according to claim 1, wherein the support base includes anchors for securing the trailer to the support base.

15. A carrier according to claim 14, wherein the anchors comprises D-rings pivotally mounted to the support base.

16. A carrier according to claim 1, wherein the bottom of the support base includes at least four mounting fixtures.

17. A carrier according to claim 16, wherein the sides of the support base includes at least four mounting fixtures.

18. A system for transporting at least one highway trailer, comprising:

a highway trailer carrier; and at least one stacking device, wherein the carrier comprises:

a support base having a support area for accommodating trailer wheels;

at least one lift brace attached to the support base;

at least one trailer support attached to the support base for supporting a part of the trailer remote from the trailer wheels;

wherein at least the support base includes a plurality of mounting fixtures; and wherein the mounting fixtures on the support base are adapted for receiving twist locks of the stacking device.

19. A system according to claim 18, wherein at least one lift brace comprises a front lift brace and a back lift brace attached respectively to front and back portions of the support base, and wherein each of the lift braces includes at least two mounting fixtures adapted for receiving the twist locks on the stacking device.

20. A system according to claim 19, wherein the bottom of the support base includes at least four mounting fixtures adapted for receiving the twist locks on the stacking device.

21. A system according to claim 20, wherein the sides of the support base includes at least four mounting fixtures for locking a plurality of carriers side-by-side with twist locks.

22. A method of transporting a highway trailer on a transport, comprising the steps of:

providing a carrier for supporting the trailer, which has at least a set of rear wheels;

loading the trailer onto the carrier by backing the trailer onto the carrier;

supporting a front end portion of the trailer on the carrier;

anchoring the trailer to the carrier;

providing at least one stacking device;

locking the stacking device onto a stationary part of the transport;

lifting the carrier and lowering the carrier onto the stacking device; and locking the carrier to the stacking device.

23. A method according to claim 22, wherein the stationary part of the transport includes a deck of the transport, one of more cargo containers anchored to the transport, or other carrier.

24. A method according to claim 23, wherein the carrier includes a support base for supporting the trailer and a front lift brace and a back lift brace attached respectively to front and back portions of the support base, and wherein each of the lift braces includes at least two mounting fixtures adapted for receiving the twist locks on the stacking device.

25. A method according to claim 24, wherein the bottom of the support base includes at least four mounting fixtures adapted for receiving the twist locks on the stacking device.

26. A method according to claim 25, wherein the sides of the support base includes at least four mounting fixtures for locking a plurality of carriers side-by-side with twist locks.

* * * * *